US010544686B2

(12) United States Patent
Zemitis et al.

(10) Patent No.: US 10,544,686 B2
(45) Date of Patent: Jan. 28, 2020

(54) TURBINE BUCKET WITH A COOLING CIRCUIT HAVING ASYMMETRIC ROOT TURN

(71) Applicant: General Electric Company, Schenectady, NY (US)

(72) Inventors: William Scott Zemitis, Greenville, SC (US); Michael Sherman, Greenville, SC (US); Luke C. Sponseller, Greenville, SC (US)

(73) Assignee: General Electric Company, Schenectady, NY (US)

( * ) Notice: Subject to any disclaimer, the term of this patent is extended or adjusted under 35 U.S.C. 154(b) by 84 days.

(21) Appl. No.: 15/816,240

(22) Filed: Nov. 17, 2017

(65) Prior Publication Data

US 2019/0153871 A1 May 23, 2019

(51) Int. Cl.
*F01D 5/18* (2006.01)

(52) U.S. Cl.
CPC ..... *F01D 5/187* (2013.01); *F05D 2220/32* (2013.01); *F05D 2240/81* (2013.01); *F05D 2260/221* (2013.01); *F05D 2260/941* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,873,695 | A * | 2/1999 | Takeishi | F01D 5/187 415/115 |
| 8,562,286 | B2 | 10/2013 | Gleiner et al. | |
| 8,974,182 | B2 | 3/2015 | Boyer et al. | |
| 2004/0094287 | A1 | 5/2004 | Wang | |
| 2007/0189898 | A1 | 8/2007 | Hooper et al. | |
| 2013/0209253 | A1 | 8/2013 | Zemitis et al. | |
| 2015/0110639 | A1 | 4/2015 | Herzlinger et al. | |
| 2016/0319680 | A1 | 11/2016 | Roman-Morales et al. | |
| 2017/0002664 | A1 | 1/2017 | McKenzie et al. | |

* cited by examiner

*Primary Examiner* — Ninh H. Nguyen
*Assistant Examiner* — Maxime M Adjagbe
(74) *Attorney, Agent, or Firm* — Eversheds Sutherland (US) LLP

(57) ABSTRACT

The present application provides a turbine bucket. The turbine bucket may include a platform, an airfoil extending from the platform at an intersection thereof, and a cooling circuit extending within the platform and the airfoil. The cooling circuit may include a root turn with an asymmetric shape so as to reduce stress concentrations therein.

11 Claims, 4 Drawing Sheets

TURBINE BUCKET WITH A COOLING CIRCUIT HAVING ASYMMETRIC ROOT TURN

TECHNICAL FIELD

The present application and the resultant patent relate generally to gas turbine engines and more particularly relate to a gas turbine engine with a turbine bucket having an airfoil with a cooling circuit having an asymmetric root turn so as to promote stress reduction.

BACKGROUND OF THE INVENTION

Known gas turbine engines generally include rows of circumferentially spaced nozzles and buckets. A turbine bucket generally includes an airfoil having a pressure side and a suction side and extending radially upward from a platform. A hollow shank portion may extend radially downward from the platform and may include a dovetail and the like so as to secure the turbine bucket to a turbine wheel. The platform generally defines an inner boundary for the hot combustion gases flowing through a gas path. As such, the intersection of the platform and the airfoil may be an area of high stress concentration due to the hot combustion gases, the mechanical loading thereon, and other causes.

More specifically, there is often a large amount of thermally or otherwise induced strain at the intersection of an airfoil and a platform. This induced strain may be due to the temperature differentials between the airfoil and the platform and between the pressure side and the suction side as well as due to rotational velocity loading. The induced strain may combine with geometric discontinuities in the region so as to create areas of very high stress that may limit overall component lifetime. To date, these issues have been addressed by attempting to keep geometric discontinuities such as root turns, tip turns, internal ribs, and the like, away from the intersection. Further, attempts have been made to control the temperature about the intersection. Temperature control, however, generally requires additional cooling flows at the expense of overall engine efficiency. These known cooling arrangements thus may be difficult and expensive to manufacture and/or may require the use of an excessive amount of air or other types of parasitic cooling flows.

SUMMARY OF THE INVENTION

The present application and the resultant patent thus provide a turbine bucket. The turbine bucket may include a platform, an airfoil extending from the platform at an intersection thereof, and a cooling circuit extending within the platform and the airfoil. The cooling circuit may include a root turn with an asymmetric shape so as to reduce stress concentrations therein.

The present application and the resultant patent further provide a turbine bucket. The turbine bucket may include a platform, an airfoil extending from the platform at an intersection thereof, and a serpentine cooling circuit extending within the platform and the airfoil. The serpentine cooling circuit may include a number of root turns with an asymmetric shape having a built up area and a reduced area so as to reduce stress concentrations therein.

These and other features and improvement of the present application and the resultant patent will become apparent to one of ordinary skill in the art upon review of the following detailed description when taken in conjunction with the several drawings and the appended claims.

DETAILED DESCRIPTION

Figure 1:
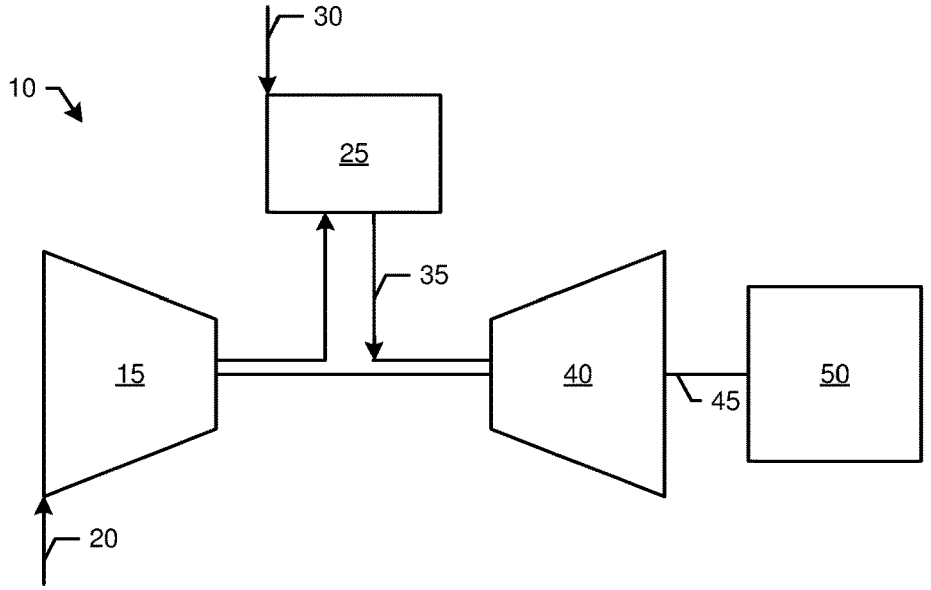
FIG. 1 is a schematic diagram of a gas turbine engine with a compressor, a combustor, a turbine, and a load.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, liquid fuels, and/or other types of fuels and blends thereof. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
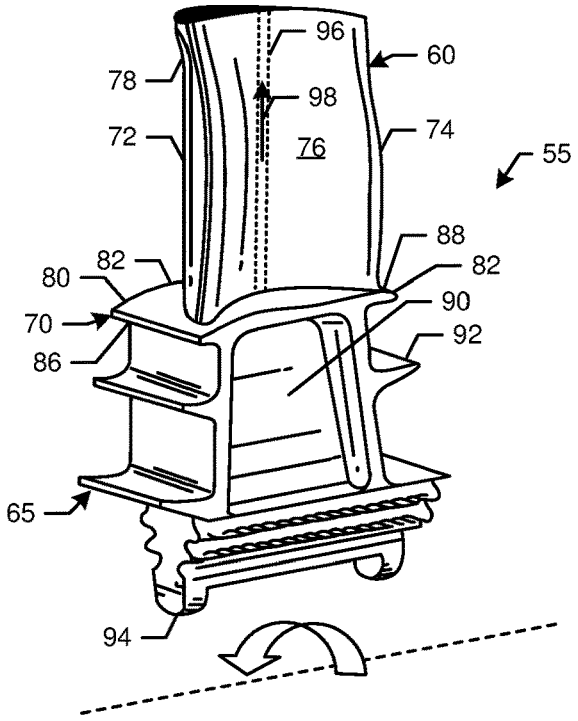
FIG. 2 is a perspective view of a known turbine bucket.

FIG. 2 shows an example of a turbine bucket 55 that may be used with the turbine 40. Generally described, the turbine bucket 55 includes an airfoil 60, a shank portion 65, and a platform 70 disposed between the airfoil 60 and the shank portion 65. The airfoil 60 generally extends radially upward from the platform 70 and includes a leading edge 72 and a trailing edge 74. The airfoil 60 also may include a concave wall defining a pressure side 76 and a convex wall defining a suction side 78. The platform 70 may be substantially horizontal and planar. Likewise, the platform 70 may include a top surface 80, a pressure face 82, a suction face 84, a forward face 86, and an aft face 88. The top surface 80 of the platform 70 may be exposed to the flow of the hot combustion gases 35. The shank portion 65 may extend radially downward from the platform 70 such that the platform 70 generally defines an interface between the airfoil 60 and the shank portion 65. The shank portion 65 may include a shank cavity 90 therein. The shank portion 65 also may include one or more angle wings 92 and a root structure 94 such as a dovetail and the like. The root structure 94 may be configured to secure the turbine bucket 55 to the shaft 45. Other components and other configurations may be used herein.

The turbine bucket 55 may include one or more cooling circuits 96 extending therethrough for flowing a cooling medium 98 such as air from the compressor 15 or from another source. The cooling circuits 96 and the cooling medium 98 may circulate at least through portions of the airfoil 60, the shank portion 65, and the platform 70 in any order, direction, or route. Many different types of cooling circuits and cooling mediums may be used herein. Other components and other configurations also may be used herein.

Figure 3:
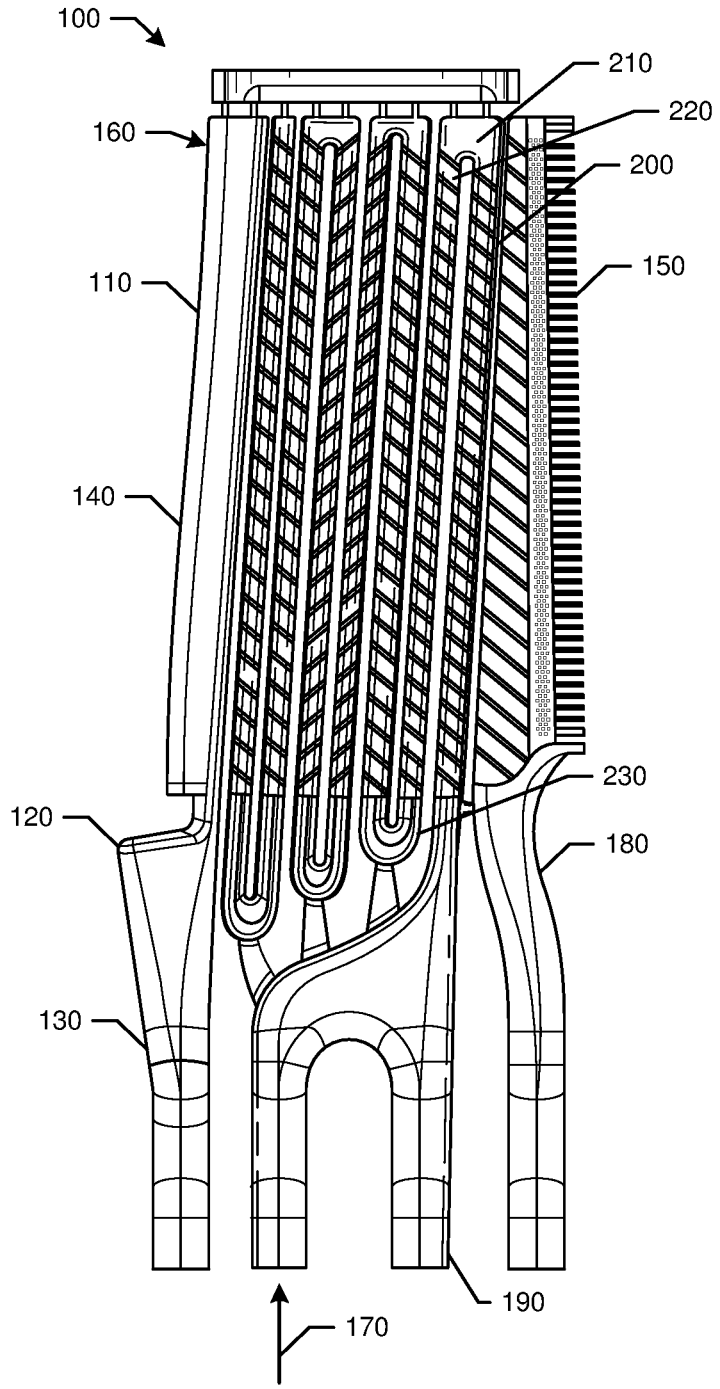
FIG. 3 is a side plan view of a core body of a turbine bucket as may be described herein.

FIG. 3 shows an example of a portion of a turbine bucket 100 as may be described herein. The turbine bucket 100 may include an airfoil 110, a platform 120, and a shank portion 130. Similar to that described above, the airfoil 110 extends radially upward from the platform 120 and includes a leading edge 140 and a trailing edge 150. Within the turbine bucket 100 there may be a number of core cavities 160. The core cavities 160 may supply a cooling medium 170 to the components thereof so as to cool the overall turbine bucket 100. The cooling medium 170 may be air, steam, and the like from any source. The core cavities 160 may define one or more serpentine cooling circuits 180 extending therethrough. Specifically, each serpentine cooling circuit 180 may extend from a cooling input 190 about the shank portion 130 towards the platform 120 and the airfoil 110. The serpentine cooling circuit 180 may extend along a first channel 200 in a first direction through the airfoil 110, reverse direction through a tip turn 210, extend along a second channel 220 in a second direction, again reverse direction through a root turn 230, extend back through a further first channel 200 in the first direction, and so forth in any number of repeats. Other components and other configurations may be used.

Figure 4:
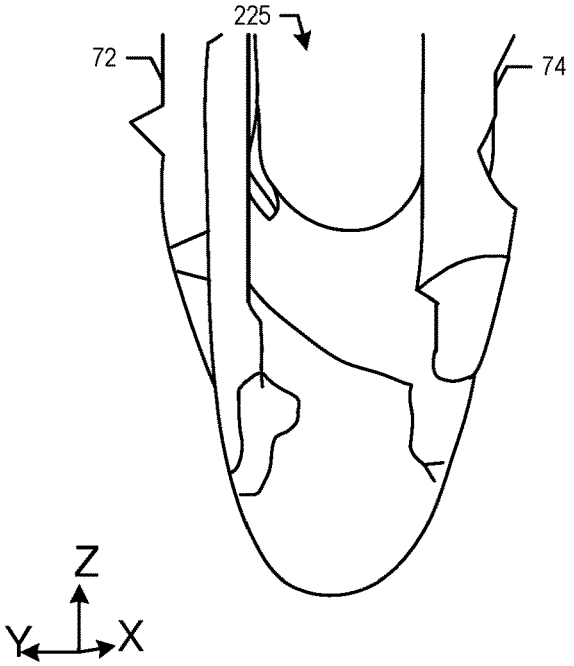
FIG. 4 is an expanded view of a symmetrical root turn.
Figure 5:
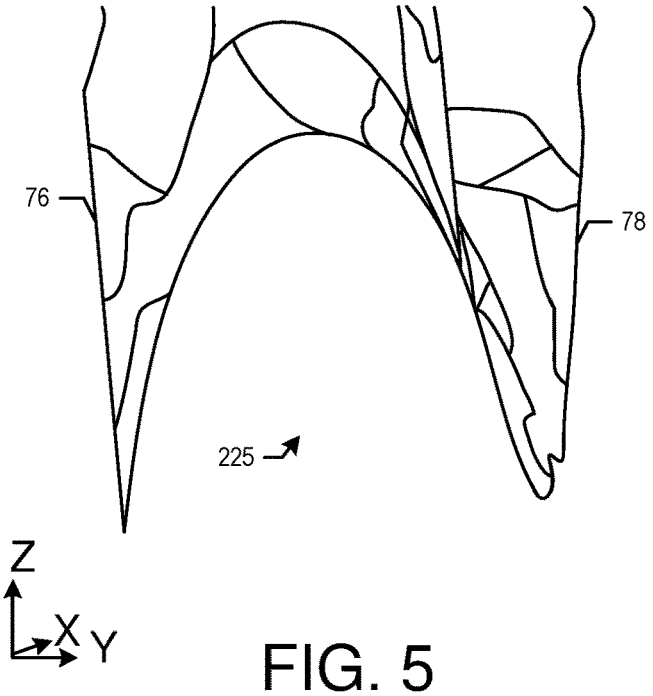
FIG. 5 is a further expanded view of the symmetrical root turn of FIG. 4

Conventional root turns generally utilized a symmetric turn with round blends and fillets. FIGS. 4 and 5 show a typical, largely symmetric root turn 225. Specifically, FIG. 4 shows the root turn 225 from the leading edge 72 to the trailing edge 74. FIG. 5 shows the root turn from the root turn 225 from the pressure side 76 to the suction side 78.

Figure 6:
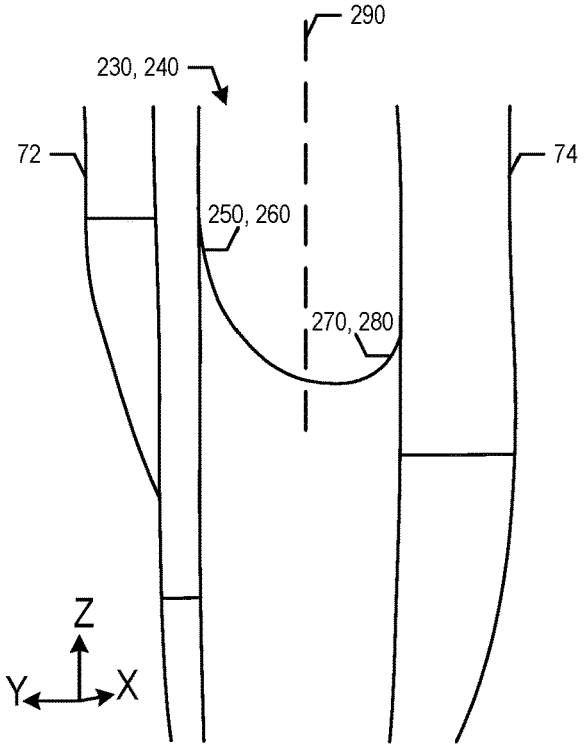
FIG. 6 is an expanded view of an asymmetrical root turn as may be described herein.
Figure 7:
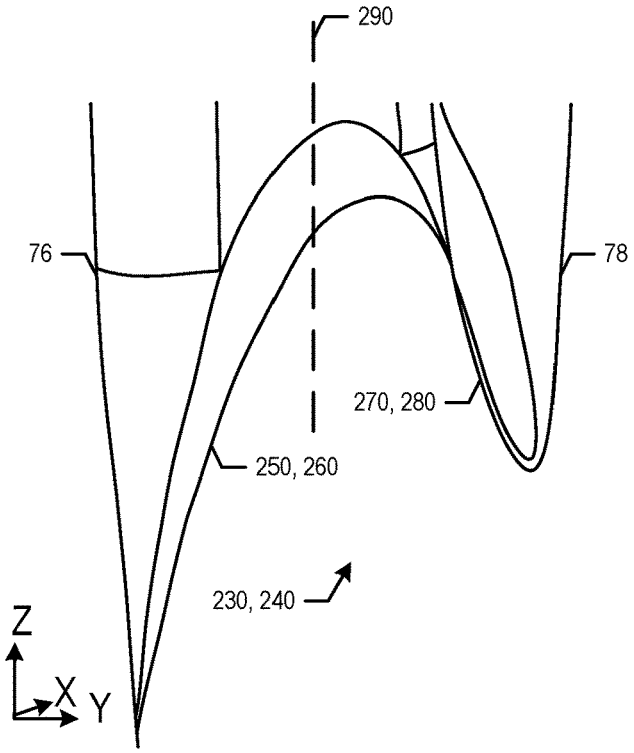
FIG. 7 is a further expanded view of the asymmetrical root turn of FIG. 6.

FIGS. 6 and 7 show an expanded view of a root turn 230 described herein. Specifically, the root turn 230 may include an asymmetric shape 240. The asymmetric shape 240 may minimize the curvature of the turn in higher stress regions and increase curvature in regions of lower stress so as to reduce overall stress concentrations therein. Specifically, FIG. 6 shows the root turn 230 from the leading edge 72 to the trailing edge 74. FIG. 7 shows the root turn from the root turn 225 from the pressure side 76 to the suction side 78. The asymmetric shape 240 may be determined by numerical modeling and field experience. Generally described, a first side 250 of the asymmetric turn 240 may now have a built up area 260 as compared to a second side 270 which may have a recessed area 280 with less material. The first side 250 or the second side 260 may extend beyond a center line 290 at an off center angle for any distance. The nature of the asymmetric shape 240 may vary according to the overall geometry of the turbine bucket 100.

The definition of curvature is: $k=1/R$. When one increases curvature, one is reducing the local radius. Here, the asymmetric shape 240 increases the local radius in high stress regions (decreasing curvature) and reduces the local radius in lower stress regions (increasing curvature). Although the changes are shown from the side of the blade, the curvature may be altered in any dimension. Specifically, while curvature may be reduced in one dominant plane, it further may be reduced by adjustments in the other plane as well.

The ideal ratio of the radii on the sides of the turn may be determined by numerical analysis and may be dependent on the unique materials, temperatures, rotational velocity loads, and passage flow area requirements involved. The maximum useful stress reduction may lie as some point between the two designs. Overall stress concentrations may be reduced by twenty percent or more so as to provide a lifetime improvement of two to three times or more. Such an improved useful lifetime is significant in terms of cost and downtime. Other components and other configurations may be used herein.

The use of the asymmetric shape 240 in the root turn 230 thus reduces the stress concentrations therein while maintaining an adequate cooling flow therethrough. Reducing stresses at the root turn 230 should provide increased overall lifetime with reduced maintenance and reduced costs. Further, excessive amounts of the cooling medium 170 may not be required herein. The overall impact of thermal expansion and other causes of stress on the turbine bucket 100 thus may be reduced.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine bucket, comprising:

a platform;

an airfoil extending from the platform at an intersection thereof;

wherein the airfoil comprises a leading edge and a trailing edge and a pressure side and a suction side; and a cooling circuit extending within the platform and the airfoil;

wherein the cooling circuit comprises a root turn with an asymmetric shape extending from both the leading edge to the trailing edge and from the pressure side to the suction side so as to reduce stress concentrations therein.

2. The turbine bucket of claim 1, wherein the cooling circuit comprises a serpentine cooling circuit.

3. The turbine bucket of claim 1, further comprising a plurality of root turns with the asymmetric shape.

4. The turbine bucket of claim 1, wherein the root turn with the asymmetric shape extends from a first channel to a second channel.

5. The turbine bucket of claim 4, wherein the first channel and the second channel extend to a tip turn.

6. The turbine bucket of claim 5, further comprising a plurality of tip turns.

7. The turbine bucket of claim 4, wherein the first channel extends from a cooling input.

8. The turbine bucket of claim 1, further comprising a shank extending from the platform.

9. The turbine bucket of claim 1, wherein the cooling circuit extends through a core cavity.

10. The turbine bucket of claim 1, wherein the cooling circuit comprises a cooling medium therein.

11. A turbine bucket, comprising:

a platform;

an airfoil extending from the platform at an intersection thereof;

wherein the airfoil comprises a leading edge and a trailing edge and a pressure side and a suction side; and a serpentine cooling circuit extending within the platform and the airfoil;

wherein the serpentine cooling circuit comprises a plurality of root turns with an asymmetric shape extending from both the leading edge to the trailing edge and from the pressure side to the suction side having a built up area and a recessed area so as to reduce stress concentrations therein.

* * * * *